United States Patent [19]

Werner, Jr.

[11] 4,417,804

[45] Nov. 29, 1983

[54] HIGH VOLTAGE COMPARATOR FOR PHOTORECEPTOR VOLTAGE CONTROL

[75] Inventor: Alan J. Werner, Jr., Rochester, N.Y.

[73] Assignee: Xerox Corporation, Stamford, Conn.

[21] Appl. No.: 275,174

[22] Filed: Jun. 19, 1981

[51] Int. Cl.[3] ..... G03G 15/00

[52] U.S. Cl. ..... 355/14 CH; 250/324; 355/3 CH; 361/235

[58] Field of Search ..... 355/3 R, 3 CH, 14 CH; 250/324, 325, 326; 361/235

[56] References Cited

U.S. PATENT DOCUMENTS

| | | | |
|---|---|---|---|
| 3,586,908 | 6/1971 | Vosteen | 317/4 |
| 3,678,350 | 7/1972 | Matsumoto et al. | 317/262 A |
| 3,699,388 | 10/1972 | Ukai | 317/4 |
| 3,763,410 | 10/1973 | Phillips | 317/262 A |
| 3,805,069 | 4/1974 | Fisher | 250/326 |
| 3,934,141 | 1/1976 | Vargas | 250/326 X |
| 3,950,680 | 4/1976 | Michaels | 317/262 A |
| 3,970,920 | 7/1976 | Braun | 324/455 |
| 3,976,880 | 8/1976 | Brunelle et al. | 250/324 |
| 3,976,881 | 8/1976 | Parker | 250/324 |
| 4,086,650 | 4/1978 | Davis | 361/229 |
| 4,166,690 | 9/1979 | Bacon et al. | 355/3 CH |
| 4,167,325 | 9/1979 | Plumadore | 355/14 |
| 4,326,796 | 4/1982 | Champion et al. | 355/3 CH X |
| 4,346,986 | 8/1982 | Kuge et al. | 355/3 CH X |
| 4,348,099 | 9/1982 | Fantozzi | 355/14 CH X |

FOREIGN PATENT DOCUMENTS

| | | | |
|---|---|---|---|
| 55-11257 | 1/1980 | Japan | 355/3 CH |

*Primary Examiner*—Fred L. Braun

*Attorney, Agent, or Firm*—Ronald F. Chapman

[57] ABSTRACT

A photoreceptor voltage control having a comparator circuit for determining the error between the photoreceptor voltage and the desired voltage. The photoreceptor voltage is detected by a non-contacting detector and the photoreceptor voltage signal is fed directly to the comparator circuit which determines if the error is too positive, too negative or within acceptable limits. This information is then fed by a DC isolation system to the machine logic control which in turn corrects a corona supply voltage to obtain the desired photoreceptor voltage.

12 Claims, 5 Drawing Figures

HIGH VOLTAGE COMPARATOR FOR PHOTORECEPTOR VOLTAGE CONTROL

The invention relates to a surface potential control system, in particular to digital control system for use in electrophotography.

A typical method of photoreceptor voltage control in the prior art is to measure the voltage and adjust the parameter affecting that voltage until it agrees with the desired value. For fast response, this requires a very fast, high voltage output stage. Often a feedback, non-contacting electrostatic voltmeter is used to sense the photoreceptor voltage. The output of the voltmeter feeds a system that compares this output with the desired value of photoreceptor voltage. In response to this comparison, a corona supply is varied to obtain the desired voltage.

U.S. Pat. No. 3,586,908 describes one of these typical prior art voltage control systems. In particular, the error between the photoreceptor and the reference voltage is sensed via a non-contacting detector. The error voltage is then integrated and the result is fed into a high voltage output stage. This high voltage output stage varies the effective voltage from the corona supply. The output from the corona supply in turn corrects the voltage on the photoreceptor until the error is reduced to zero. A programmable corona supply could also be used where the programming signal is derived from the high voltage output stage.

A problem with prior art voltage control devices, as described, is the "dead time lag" due to the time lag between the change of voltage caused by the corona source and the sensing of the change by the non-contacting detector. This is caused by the physical separation of the corona source and the detector head and by the finite speed of the photoreceptor. The result is a very slow system response in order to maintain stability. Therefore, it is impossible to take fast measurements from discrete zones.

It would be desirable to provide a photoreceptor voltage control that is simple, that can make a direct high voltage comparison of the photoreceptor voltage and the desired voltage and in which the speed of detection is limited only by the speed of the detector.

It is therefore an object of the present invention to provide a new and improved high voltage control, and in particular a control that eliminates the slow integration step and it can be used to take measurements from discrete zones on a surface to be measured.

Further objects and advantages of the present invention become apparent as the following description proceeds and the features of novelty characterizing the invention will be pointed out in particularity in the claims annexed to and forming a part of this specification.

Briefly, the present invention is concerned with a photoreceptor voltage control comprising a comparator circuit for determining the error between the photoreceptor voltage and the desired voltage. The photoreceptor voltage is detected by a non-contacting detector and the photoreceptor voltage signal is fed directly to the comparator circuit which determines if the error is too positive, too negative or within acceptable limits. This information is then fed by a DC isolation system to the machine logic control which in turn corrects a corona supply voltage to obtain the desired photoreceptor voltage.

For a better understanding of the present invention, reference may be had to the accompanying drawings wherein the same reference numerals have been applied to like parts and wherein.

Figure 1:
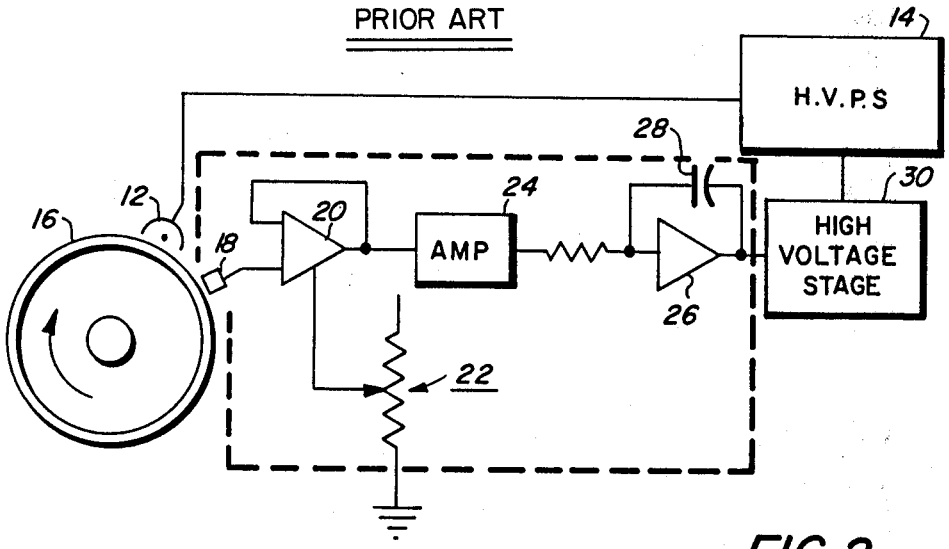
FIG. 1 PRIOR ART
FIG. 1 is a typical prior art voltage control system

Referring now to FIG. 1, there is illustrated the variable resistance control typical of a prior art device. In particular, a corona voltage source 12 connected to high voltage power supply 14 charges the surface of the rotating photoreceptor 16. A detector 18 senses the voltage on the photoreceptor surface of the photoreceptor 16 and the detector 18 provides an input to the preamplifier 20. The preamplifier 20 is also connected to a high voltage reference supply shown generally at 22. An amplifier 24 is connected to the output of the preamplifier 20 and in turn is interconnected to an integrator circuit including op amp 26 and capacitor 28. The output of the op amp 26 is connected to a high voltage stage 30 in turn connected to the high voltage power supply 14. As seen in FIG. 1, the input to the op amp 26 and the output of the op amp 26 is an analog signal and a fast responding high voltage stage 30 is required.

Figure 2:
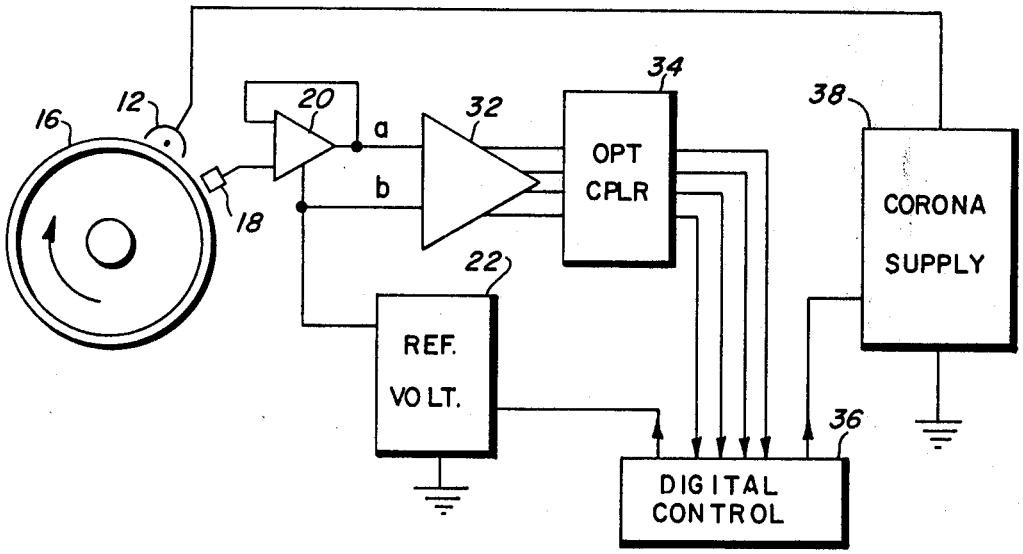
FIG. 2 is a voltage control system in accordance with the present invention.

With reference to FIG. 2, there is also shown a corona voltage source 12 charging the surface of a photoreceptor 16. A detector 18 provides a signal representative of the voltage on the surface of the photoreceptor 16 to the pre-amplifier 20.

Any type of non-loading electrostatic detector will work, for example, a variable capacitor, chopper or shutter type modulation, or a very high impedance contacting type such as radioactive probes as long as the detector does not significantly degrade the information on the surface of the photoreceptor.

In accordance with the present invention, however, a comparator 32 is connected to the preamplifier 20. There are two inputs to the comparator 32, namely, line a from amplifier 20 and line b from the high voltage reference supply 22.

The output of the comparator 32 is connected to a DC isolator 34, preferably an optical coupler, in turn connected to the machine digital control 36. The machine digital control can be any standard microprocessor or other suitable logic control. The machine control 36 is also connected to the reference voltage supply 22 and the high voltage corona supply 38.

In operation, the comparator 32 detects the voltage difference between the photoreceptor voltage provided at detector 18 and the reference voltage 22 and provides a digital output depending upon the relative difference between the voltages.

Figure 3:
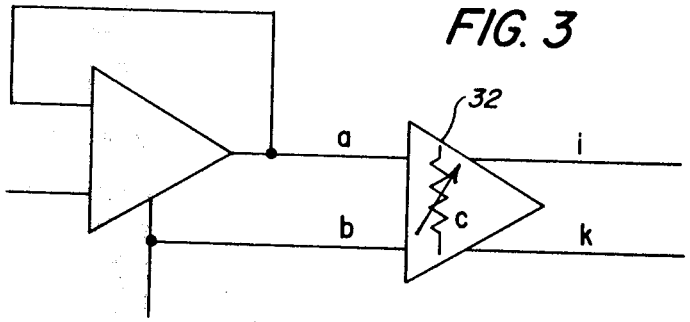
FIGS. 3 and 4 illustrate typical input/output relationships for the comparator of FIG. 2.

With reference to FIG. 3, if the error between the inputs a and b is greater than a reference level c, either output line i or k is activated depending upon the polarity of the error. The polarity of the error indicates if the error is higher or lower than the allowable error band *2c*. This is further illustrated with reference to Truth Table I.

TRUTH TABLE I

| | i | k |
|---|---|---|
| $-c \leqq (a-b) \leqq c$ | 0 | 0 |

TRUTH TABLE I-continued

| | i | k |
|---|---|---|
| (a − b) > c | 1 | 0 |
| (a − b) < −c | 0 | 1 |

Thus, if (a−b) is less than reference level c, line k is activated, if (a−b) is greater than reference level c, line i is activated, and if (a−b) is between the range −c to +c, neither line i nor k is activated.

The digital output of the comparator 32 (lines i and k) is then conveyed via the optical coupler 34 to the digital control 36. The digital control 36 in response to the digital error signal (lines i and k) controls the high voltage supply 38 to raise or lower the voltage on the photoreceptor surface. It should be noted that since the output of the non-contacting detector 18 is directly proportional to the voltage error between the photoreceptor surface and the reference supply 22 and inversely proportional to the distance between the photoreceptor and the detector, the system error becomes a compromise among noise, distance and desired accuracy.

Figure 4:
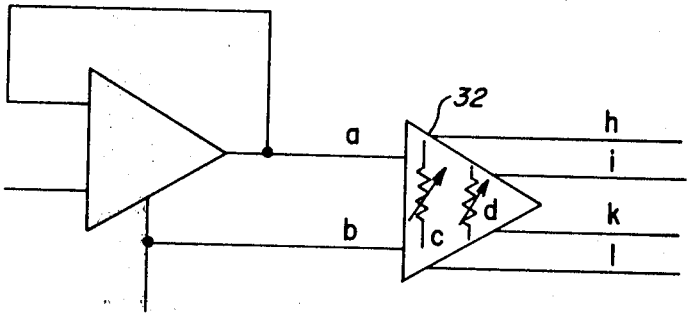

A more precise control is shown with reference to the comparator in FIG. 4. The four outputs h, i, k and l provide for minor corrections in response to relatively small deviations from the error band 2c and also provide major corrections in response to relatively large deviations from the error band 2c determine by deviations from a second error band 2d. This is further illustrated with respect to Truth Table II.

TRUTH TABLE II

| | h | i | k | l |
|---|---|---|---|---|
| −c ≦ (a − b) ≦ c | 0 | 0 | 0 | 0 |
| c < (a − b) ≦ d | 0 | 1 | 0 | 0 |
| −d < (a − b) ≦ −c | 0 | 0 | 1 | 0 |
| (a − b) > d | 1 | 0 | 0 | 0 |
| (a − b) < −d | 0 | 0 | 0 | 1 |

Thus, no correction is necessary if the error (a−b) is in the range −c to +c. If the error (a−b) is greater than reference level c but less than or equal to reference level d, then line i is activated. If the error (a−b) is greater than −d but less than or equal to −c, the line k is activated.

Figure 5:
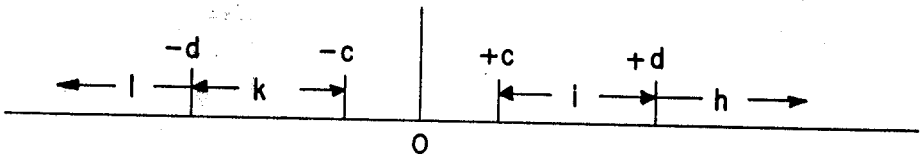
FIG. 5 illustrates the error correction bands for the relationships of FIG. 4.

This is further illustrated in FIG. 5 with i and k representing the error between c and d and between −c and −d respectively. A second range of deviation is illustrated by h and l.

With reference to Table II, if (a−b) is greater than d, line h is activated and if (a−b) is less than −d, line l is activated. If either line h or l is activated, the high voltage supply 38 will raise or lower the voltage on the photoreceptor surface a greater amount than if line i or k is activated. This will compensate for the greater deviation of the (a−b) error from the *2c* error band than if line i or k were activated.

While the proposed high voltage comparator 32 is useful to control photoreceptor voltage, it may also be used to measure the photoreceptor voltage. This can be done by correcting the high voltage reference supply 22 to match the photoreceptor voltage. Reading the reference supply voltage with any suitable (not shown) meter can then provide the photoreceptor voltage.

Since the speed of error detection is limited by the speed of the detector rather than the requirement for stability of an internal feedback loop used in the feedback type voltage control, it is therefore ideally suited for measuring narrow interdocument areas on the photoreceptor surface at high photoreceptor speeds. In addition, the high voltage reference supply 22 can be slow since it changes only on command for a different voltage. It can therefore be easily filtered to reduce noise problems and can be remotely located if desired.

Several discrete levels of error can be detected by the comparator 32 if desired so that the machine digital control 36 can correct by different amounts for different error levels.

While there has been illustrated and described what is at present considered to be a preferred embodiment of the present invention, it will be appreciated that numerous changes and modifications are likely to occur to those skilled in the art and it is intended in the appended claims to cover all those changes and modifications which fall within the true spirit and scope of the present invention.

I claim:

1. An automatic electrostatic voltage control system for use with the electrophotography apparatus for directly comparing a reference supply with the voltage on a photoreceptor surface, the control having a high voltage supply to maintain the surface at a preset fixed potential comprising:

a detector electrostatically coupled to the surface to produce a control signal indicative of the polarity of the voltage difference of the surface relative to the present fixed potential, a comparator, a premaplifier interconnecting the detector and the comparator, and a digital control connected to the output of the comparator and to the high voltage supply, the digital control responding to the output of the comparator to supply a corresponding voltage to the high voltage supply to cause the supply to maintain the surface at the preset fixed potential.

2. The system of claim 1 wherein there is no output from the comparator if the difference between the potential of the surface and the preset fixed potential is within a first reference range and an output if the difference is outside the first reference range.

3. The system of claim 2 wherein there is an output from the comparator of a first magnitude if the difference is outside the first reference range but within a second reference range.

4. The system of claim 3 wherein there is an output from the comparator of a second magnitude if the difference is outside the second reference range.

5. A photoreceptor electrostatic voltage control comprising:

a detector, a preamplifier connected to the detector a reference voltage supply connected to the preamplifier, a comparator connected to the output of the preamplifier, an optical coupler connected to the comparator, the comparator providing an error signal between the photoreceptor voltage as sensed by the detector and the reference voltage, the comparator determining if the error is positive or negative to directly compare the reference voltage to the photoreceptor voltage, a logic controller, and a high voltage supply connected to the logic controller, the logic controller providing a signal to the high voltage supply to generate a voltage on the photoreceptor corresponding to the reference voltage.

6. The voltage control of claim 5 wherein the comparator provides a first digital signal if the reference supply voltage is less than the photoreceptor voltage and provides a second digital signal if the reference supply voltage is greater than the photoreceptor voltage.

7. Apparatus to sense photoreceptor electrostatic voltage by measuring the difference between the photoreceptor voltage and a sensor device comprising a detector, a preamplifier connected to the detector, a reference voltage supply connected to the preamplifier, a comparator connected to the output of the preamplifier, a logic controller, and an isolation device connecting the logic controller to the comparator, the comparator providing an error signal between the photoreceptor voltage as sensed by the detector and the reference voltage, whereby the reference voltage is changed to match the photoreceptor voltage.

8. The apparatus of claim 7 wherein the isolation device is an optical coupler.

9. The apparatus of claim 7 wherein there is no output from the comparator if the error signal is within a first reference range and an output if the error signal is outside the first reference range.

10. The apparatus of claim 9 wherein there is an output from the comparator of a first magnitude if the error signal is outside the first reference range but within a second reference range.

11. The apparatus of claim 10 wherein there is an output from the comparator of a second magnitude and the error signal is outside the second reference range.

12. An automatic electrostatic voltage control system for use with the electrophotography apparatus for directly comparing a reference supply with the voltage on a photoreceptor surface, the control having a high voltage supply to maintain the surface at a preset fixed potential comprising:

a detector electrostatically coupled to the surface to produce a control signal indicative of the polarity of the voltage difference of the surface relative to the present fixed potential, a comparator, an optical coupler, and a digital control connected to the output of the comparator through the optical coupler and to the high voltage supply, the digital control responding to the output of the comparator to supply a corresponding voltage to the high voltage supply to cause the supply to maintain the surface at the preset fixed potential.

* * * * *